US006250545B1

(12) United States Patent
Mazzarolo et al.

(10) Patent No.: US 6,250,545 B1
(45) Date of Patent: Jun. 26, 2001

(54) INSULATIVE SLEEVE FOR DISPOSABLE HOT DRINK CUP

(75) Inventors: Ugo Mazzarolo, Ste. Anne DeBellevue; Vince S. Cerasani, Winnipeg, both of (CA)

(73) Assignee: M&N Plastics, Inc., Plant City, FL (US)

( * ) Notice: Subject to any disclaimer, the term of this patent is extended or adjusted under 35 U.S.C. 154(b) by 0 days.

(21) Appl. No.: 09/583,424

(22) Filed: May 31, 2000

(51) Int. Cl.[7] ..... B65D 5/62

(52) U.S. Cl. ..... 229/403; 220/592.17; 220/737; 220/739

(58) Field of Search ..... 229/403; 220/737, 220/738, 739, 903, 592.17

(56) References Cited

U.S. PATENT DOCUMENTS

| | | | | |
|---|---|---|---|---|
| Re. 25,618 | * | 7/1964 | Goodman | 229/403 |
| 4,548,349 | * | 10/1985 | Tunberg | 220/738 |
| 4,685,583 | * | 8/1987 | Noon | 220/737 |
| 5,102,036 | * | 4/1992 | Orr et al. | 220/903 |
| 5,205,473 | | 4/1993 | Coffin, Sr. . | |
| 5,385,260 | | 1/1995 | Gatcomb . | |
| 5,425,497 | | 6/1995 | Sorensen . | |
| 5,454,484 | | 10/1995 | Chelossi . | |
| 5,669,553 | * | 9/1997 | Smith | 220/739 |
| 5,765,716 | * | 6/1998 | Cai et al. | 220/738 |
| 5,857,615 | * | 1/1999 | Rose | 229/403 |
| 6,053,352 | | 4/2000 | Cai . | |

* cited by examiner

*Primary Examiner*—Gary E. Elkins
(74) *Attorney, Agent, or Firm*—Young & Basile, P.C.

(57) ABSTRACT

An insulative sleeve for a hot drink cup made of essentially transparent and preferably clear thermal plastic material having circumferential bands of insulative flutes thermoformed therein.

2 Claims, 1 Drawing Sheet

INSULATIVE SLEEVE FOR DISPOSABLE HOT DRINK CUP

FIELD OF THE INVENTION

The invention relates to insulative sleeves for protecting the holder of a hot drink cup from discomfort due to heat transfer through the side wall of the cup. In general this is achieved by providing a sleeve of tapered frustoconical configuration which slips onto the outside of the hot drink cup and may be reused with other cups as desired.

BACKGROUND OF THE INVENTION

When coffee, tea, and other drinks commonly sold and dispensed in disposable paper cups are carried, in many instances the temperature of the contents of the cup is such as to create discomfort in the hands and fingers of the holder.

To combat this problem, convenience stores and fast food retail outlets often "double cup" coffee and other hot drinks. Another approach employed by some manufacturers of hot drink cups is to provide an integral band of synthetic material which is foamed in the manufacturing process to provide an insulative layer. Both of these approaches tend to be expensive.

More recently, a number of persons have designed and provided disposable sleeves which slip over the outside surface of a drink cup to provide insulation between the contents of the cup and the hands and fingers of the holder. These sleeves take numerous forms and are made of paper. One characteristic common to most or all of these sleeves is the fact that they are opaque and, for this reason, obscure the trade dress and ornamental designs which the manufacturers of the hot drink cups take pains to provide.

SUMMARY OF THE INVENTION

The present invention provides an insulative protective sleeve which can be readily slipped onto the outside surface of a conventional tapered hot drink cup and which is effective to insulate the fingers to the user from the heat of the cup contents. The sleeve of the present invention is made of thermoformed plastic; preferably but not necessarily of such transparency that it does not obscure the trade dress and ornamental designs which are printed on the outside surface of the underlying drink cup. In general, the invention and its advantages are provided in the form of a sleeve of thermoformable plastic into which a pattern of raised features is impressed by thermoforming to provide an insulative character. The pattern may for example, comprise flutes or ridges which are thermoformed into the material in sheet form during the manufacturing process. Other patterns are possible.

Preferably, the manufacturing process involves extruding a sheet of clear thermoformable plastic material, thermoforming portions of said sheet to define arcuate bands of raised patterns such as longitudinal flutes or ridges and thereafter die cutting the bands from the sheet material. The sleeves may be stocked and boxed and shipped to users in large quantities at low cost.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENT

Figure 1:
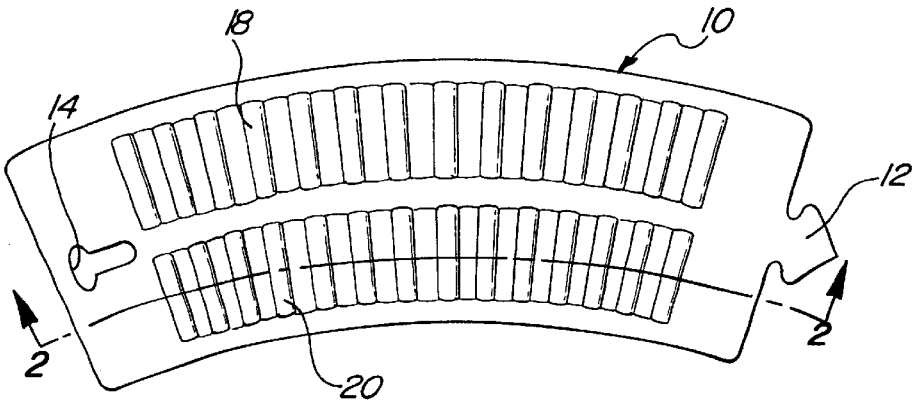
FIG. 1, is a plan view of an illustrative insulative sleeve.
Figure 2:
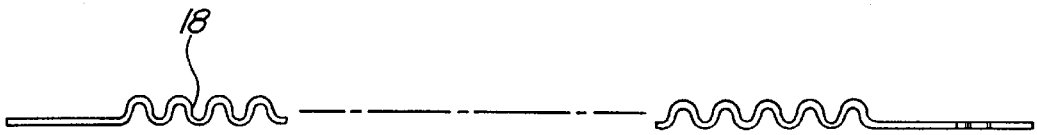
FIG. 2 is a sectional view through the sleeve of FIG. 1 along section line 2—2.

Referring to FIG. 1, there is shown an arcuate band 10 of compliant, essentially transparent light-gauge thermoformable plastic material. The band is approximately 10½ inches long by 2½ inches wide and is designed with an arcuate shape such that when the arrowhead 12 on the right side is inserted into the key slot 14 in the left side, a frusto-conical, i.e. tapered, sleeve is provided which will slip onto a conventional, commercially available hot drink cup in such a fashion as to surround the sidewall of the cup where a user typically places his hand and fingers to grasp and hold the cup during use. The dimensions given above are purely illustrative and vary depending on the size of the drink cup, e.g., 8, 12, 16 and 24 ounces.

As shown in the drawings, the band 12 has a thermoformed pattern impressed therein during the manufacturing process consisting of an upper band 18 and a lower band 20 of flutes which run parallel to one another and transverse of the band as shown in FIG. 1. Accordingly the flutes are parallel to the longitudinal axis of symmetry of the hot drink cup when assembled in the manner shown in FIG. 3. The flutes are approximately two to three millimeters in width; i.e., when measured from base to base and about 2 millimeters in height. The bands 18 and 20 are between two and three centimeters in width measured from top to bottom as viewed in FIG. 1. The bands 18 and 20 are separated by approximately ⅛ of an inch for decorative purposes; a band of continuous flutes may also be employed. The flutes provide air spaces and physically separate the user's fingers from the cup.

The flute pattern is merely illustrative; i.e., other patterns such a closely grouped hemispheres, geometric figures, cartoon characters and/or combinations of these may be used, the important features being (1) a raised pattern to provide trapped air and (2) nestability of the bands in stacked form for shipping.

Figure 3:
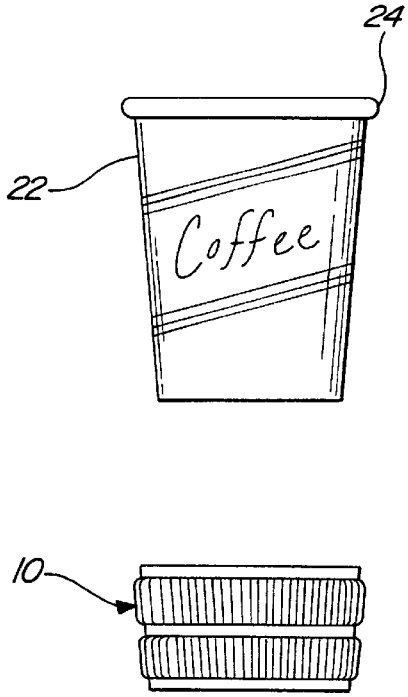
FIG. 3 is an exploded view indicating the manner in which the assembled sleeve of FIG. 1 is used.

As shown in FIG. 3, the band 10 is formed into a sleeve by the user or by a store attendant into the frusto-conical shape by joining the arrowhead 12 with the key slot 14. Thereafter, the band 10 is slipped over the bottom of the cup 22 where it typically conforms to the outside surface of the cup just below the lip 24 of the cup to provide insulation for the user of the cup. The 2½ inch width of the band is typically sufficient to protect the entire hand of the typical user. Because the material of the band 10 is transparent and preferably clear, i.e. colorless, it does not materially detract from the trade dress or design which is printed on the outside surface of the hot cup 22, as shown in FIG. 3; but, rather, permits that trade dress and/or decorative design to be viewed through the sleeve. While the sleeve may be pigmented to provide color, it is of more universal applicability if made from clear material.

Although a particular type of end fastening means is disclosed, it will be understood and appreciated by those skilled in the sheet materials art that any of several different end forming mechanisms, including tabs and slots or snap buttons may be used. Alternatively, the bands may be preformed into sleeves and permanently joined. It is also possible to thermoform seamless sleeves, usually by forming a cup and later removing the bottom.

The material which is used to manufacture the band 10 may be any of several thermoformable plastics but is preferably polystyrene. The manufacturing process typically involves, as a first step, the manufacture of flat sheet material by hot melt extrusion. The extruded sheet preferably proceeds directly from the extruder to a rotary thermoforming platen where the raised flutes are formed into the material in the desired pattern and/or size. Thermoforming can also be done on a slat platen by intermittently stopping the movement of the sheet material, and laying a length and width of material over a thermoforming station in the form of a machined aluminum platen. Such a platen has the desired pattern formed therein along with a number of air holes which are connected to a vacuum pump for drawing air from the outside downwardly through the surface of the platen. Whether rotary or flat, the platen is, of course, heated to a temperature which permits the extruded material to be pulled by the suction into conforming relationship with the pattern which is formed in the platen. In the typical high production operation 10, 12, 20 or more of the bands may be formed on a single platen.

Thereafter the material is released from the platen and moved to a die-cutting station where a series of preformed blades cut the bands around the thermoformed flutes to form the finished bands 10 as shown in FIG. 1. The bands are then collected and boxed for shipment.

The band 10 may be reused numerous times or disposed of after one use. It may be made of recyclable plastic if desired.

What is claimed is:

1. A see-through insulative drink cup sleeve comprising:

a frustoconical sleeve of transparent thermoformable plastic material having a raised pattern thermoformed therein and of size as to be readily slipped over the bottom end of a commercial drink cup and urged into conformity with the exterior side surfaces of said cup below the rim of said cup;

wherein the raised pattern comprises a substantial continuous series of vertical flutes of about 2–3 mm. in width and with rounded peaks and valleys so as to provide thermal insulation for the user and to permit indicia on the underlying cup surface to be seen therethrough without excessive distortion.

2. The see-through insulative drink cup sleeve defined in claim 1 wherein the raised pattern comprises at least two spaced apart circumferential bands of vertical flutes separated from one another by one or more bands of non-fluted material.

* * * * *